US007591898B2

(12) United States Patent
Damrau et al.

(10) Patent No.: US 7,591,898 B2
(45) Date of Patent: Sep. 22, 2009

(54) FILM COATER METHOD AND APPARATUS

(76) Inventors: Wayne A. Damrau, 6540 Wazeecha Ridge Ct., Wisconsin Rapids, WI (US) 54494; John F. Bergin, 4474 Quarry Cir., Wisconsin Rapids, WI (US) 54495

( * ) Notice: Subject to any disclaimer, the term of this patent is extended or adjusted under 35 U.S.C. 154(b) by 0 days.

(21) Appl. No.: 11/999,944

(22) Filed: Dec. 7, 2007

(65) Prior Publication Data

US 2008/0087216 A1 Apr. 17, 2008

Related U.S. Application Data

(60) Continuation of application No. 11/041,814, filed on Jan. 21, 2005, now abandoned, which is a division of application No. 10/261,050, filed on Sep. 30, 2002, now Pat. No. 6,869,639.

(51) Int. Cl.
*B05C 1/00* (2006.01)

(52) U.S. Cl. ..... 118/227; 118/249

(58) Field of Classification Search ..... 118/227, 118/249, 261, 413, 123, 126, 58, 67, 68; 427/211, 428.14, 335, 336, 356, 359, 361
See application file for complete search history.

(56) References Cited

U.S. PATENT DOCUMENTS 2,977,243 A * 3/1961 Meier ..... 427/365
5,789,022 A * 8/1998 Kustermann et al. ..... 427/211
6,309,704 B1 * 10/2001 Hess et al. ..... 427/315

* cited by examiner

*Primary Examiner*—Brenda A Lamb
(74) *Attorney, Agent, or Firm*—Pyle & Piontek, LLC

(57) ABSTRACT

An improved film coater which utilizes one or more coater or applicators to transfer coating to the outer surfaces of at least one more rolls, which in turn transfers the coating from the roll surface to one or more sides of the web for coating paper is disclosed. The coater or applicator includes a smoothing doctor on the web and downstream of the one or more rolls, and may also utilize humidity from one of steam showers or a humidity enclosure to assist smoothing. The web may run in any direction, but preferably runs upwardly from the roll toward the doctor to reduce "film split" droplets effect. The present invention also reduces the fiber rise and arrange peel pattern on the coated web, resulting in a smooth uniform coated paper.

11 Claims, 3 Drawing Sheets

FILM COATER METHOD AND APPARATUS

This application is a continuation of Ser. No. 11/041,814, filed Jan. 21, 2005, which is to be abandoned in favor of this application, after this application is filed, which is a divisional of Ser. No. 10/261,050, filed Sep. 30, 2002, now Pat. No. 6,869,639.

DISCLOSURE

This invention relates generally to a method for operating and constructing what is known as a metering size press, film press and/or film coater, and particularly a film coater which uses a doctor to smooth the applied film of coating on the paper web. More particularly the coater and method of the present invention produce a smoother, more uniformly coated paper by reducing or eliminating film split, orange peel and/or fiber rise defects.

BACKGROUND OF THE INVENTION

In a film coater, an applicator applies a film of coating onto a roll surface and the roll surface in turn, transfers the coating onto the surface or side of a moving paper web. Generally, the film coater rolls can be paired to form a nip through which the web runs and the coating is transferred.

While various forms of applicators have been used with film coaters, one version uses a form of short dwell time coater or applicator (SDTA) to apply the coating onto the web. Generally, placement of these applicators is in the III and IV quadrants (with reference to the conventional four quadrant I, II, III and IV of a 360° circle) in order to obtain proper drainage of the coating overflow at the front gap of such type coaters.

Normally, in film coaters, the web generally runs downward through the nip formed between the pair of rolls. However, it has come to be recognized that there are disadvantages to such arrangement. One disadvantage is that all the equipment required is crowded into the lower III and IV quadrants. Also, as the roll surfaces pass by the nip and separate from the web, a film split phenomenon or action occurs, producing another disadvantage. During such film split action, small droplets or mist of coating are formed between the separating roll surface and web. Such small droplets or misting tend to fall back onto the coated web, moving downwardly as it leaves the coating nip, producing non-uniform coating defects on the just coated web.

The excess coating droplets or mist falling onto the downwardly moving web, could still produce coating imperfections even if subsequently doctored, as starting with uneven coating cannot always be overcome to form uniformly coated paper. Film split phenomenon (as the paper is locally wetter) also raises surface fibers which contributes to surface roughness on the coated web. Also, film split phenomenon causes a local uneven pattern on the coated sheet surface referred to as "orange peel pattern". Further, the higher the operating speed, the greater the problem "film split" and "film split" droplets or misting become. Prior art film coaters have had operating speeds for these reasons, producing smooth paper at about 4500 ft./minute (1370 meters/minute) or less on the lighter grade (28 to 34 lbs.) papers produced.

SUMMARY OF THE INVENTION

The method and film coater of the present invention minimize potential imperfections in the formed coated surface. To this end, the film coater is preferably constructed and operated to have the web run upwardly (and not downwardly) through the film coater nip to substantially eliminate the effect of "film split" droplets or "misting" and minimize other "film split" effects, such as orange peel and fiber rise. With such arrangement, any excess film coating droplets or mist will tend to fall back toward the film coating rolls and not, to any significant degree, onto the newly coated web itself.

In the present invention, smoothing devices are placed after the film coater application nip to carry out a smoothing operation to level any incipient orange peel pattern as well as to lay down the raised surface fibers to improve surface smoothness and final paper quality.

The film coater of the present invention is constructed to provide novel subsequent smoothing of the coated web after it leaves the film coating nip to eliminate any residual "film split" appearance. This smoothing can be provided by a rod (grooved or not), blade (flexible or bent type) or similar doctoring device. Where the smoothing takes place some distance from the film coater nip, or to enhance smoothing of the coated paper after it leaves the film coating nip, the coated web may be treated by showers, such as a water mist or steam shower, before and/or after smoothing. Another alternative would be to carry out the smoothing operation in a humid or steam environment, as might be provided by a humid or steam enclosure.

While a blade could be used, preferably the smoothing operation is carried out by a roll type smoothing doctor located downstream, and preferably above the coating nip. During smoothing, it is not anticipated or intended to remove coating, but perhaps some coating may be removed without operating outside of the scope of the present invention.

With this construction and operation, the web moves upwardly rather than downwardly, through the film coater nip wherein generally the desired coat weight of coating is applied to one or both sides of the web. The coated web then continues to travel upwardly past the showers which apply a steam or water mist to the coating, prior to and/or after moving past the smoothing doctor. Where both sides of the web are simultaneously coated, the smoothing doctors may be staggered to smooth one side at a time. Further, the web can be dried, or if need be, turned, such as by an air turn, to carry out remainder of the paper making/coating process, such as drying, subsequent coating and, typically, eventual winding of the web into a roll. As noted above, alternatively, instead of steam, a water mist shower might be utilized, the function of either shower being to keep the coating levelable to enhance smoothing and/or provide a smooth surface on the paper web. Alternatively, the above mentioned humidity or steam enclosure could be provided downstream of the nip and the smoothing take place therein. It is believed that with the present invention, coating operating speeds can be considerably increased to speeds of up to 6500 ft/minute (1981 meters/minute) or beyond, with good control of orange peel, fiber rise and surface smoothness.

OBJECTS OF THE INVENTION

Accordingly, it is an object of the present invention to provide a method and apparatus for substantially minimizing, if not altogether eliminating the effect of "film split" on the coated web surface of a film coater.

Still another object of the present invention is to provide a method and apparatus for substantially minimizing, if not altogether eliminating the effect of "film split" droplets and/or "misting."

It is another object of the present invention to provide a method of operating a film coater to provide a smooth coating at high web and coating speeds.

It is still another object of the present invention to provide a film coater for operating at high speeds to provide a smooth surface.

Yet another object of the present invention is to provide a method of operating a film coater with an upwardly running web.

Yet another object of the present invention is to provide a film coater for an upwardly running web.

A still further object of the present invention is to provide a method of operating a film coater utilizing at least one smoothing doctor.

Yet a further object of the present invention is to provide a film coater incorporating at least one smoothing doctor.

A further object of the present invention is to provide a method of operating a film coater utilizing steam and/or water mist showers.

Another object of the present invention is to provide a film coater incorporating steam and/or water mist showers.

Still a further object of the present invention is to provide a method and a film coater with an upward running web, with steam showers above the film coater nip and with at least one smoothing doctor above the film coater nip.

Yet another object of the present invention is to provide showers before and/or after the at least one smoothing doctor, which smoothing doctor may comprise a smoothing roll.

Still another object of the present invention is to provide a method and a film coater using a humid atmosphere or steam enclosure in which to carry out the smoothing operation.

These and other objects of the method and film coater of the present invention will become apparent from the following written description and accompanying drawing.

DESCRIPTION OF THE INVENTION

Figure 1:
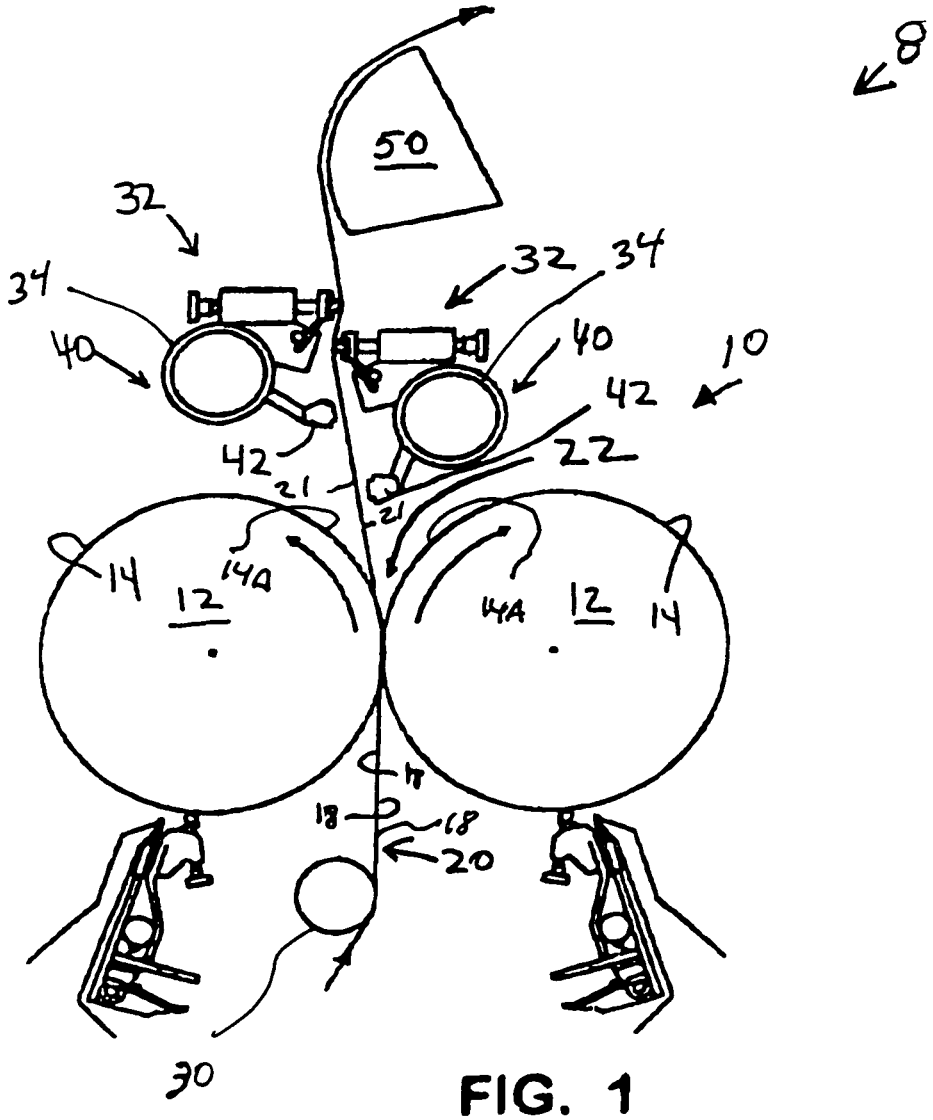
FIG. 1 is a schematic elevational view of the components and method of the present invention, illustrating a film coater with an uprunning paper web, utilizing steam and/or water mist showers below smoothing rolls to provide a smooth coated paper surface at high speeds.

Referring now to the drawings in greater detail, there is illustrated therein the method or process and apparatus generally identified by the reference numeral 8, of the present invention.

The apparatus 8 is seen to comprise a film coater 10 including at least one roll 12 onto a roll surface 14 of which at least one coating applicator 16 applies a film of coating, which is in turn transferred onto at least one side 18 of a moving paper web 20. As shown in FIG. 1, a pair of rolls 12 are generally paired to form a nip 22 therebetween through which the web 20 moves, at which point the film of coating on the two roll surfaces 14 is transferred onto the two sides 18 of the web 20 adjacent the rolls 12. The coated web is designated as 21.

Typically, if the web 20 is moved through the nip 22 in a downward direction, there are the inherent disadvantages to producing a smooth coated paper surface, as is discussed above. In the instant apparatus 8, it is desired to move the web 20 upwardly through the nip 22, and not downwardly, to eliminate the disadvantages associated with downward motion of the web 20.

As shown, the web 20 moves upwardly past a lead or guide roll 30 and into and through the nip 22, where the film of coating applied to the outer surface 14 of each roll 12 by a corresponding coating applicator 16 is transferred to a corresponding side 18 of the web 20. It is understood only one side or both sides of the web could be coated. While a "film split" action may still occur, the resulting film droplets fall back onto the roll surfaces 14A returning to the applicators 16, and the droplets do not fall onto the finished coated sheet or web 21, as they did in prior art downwardly running film coaters. Generally in the present invention, the application onto and doctoring of the new coating on the roll surfaces renders any film split droplets harmless as the roll surfaces are rewetted with fresh coating by applicators 16 prior to transferring the fresh coating again to the web 20 at nip 22.

The web 20 then proceeds upwardly past the nip 22, and engages at least one smoothing doctor 32 along and against a side 18 thereof which has a film of coating 21 thereon, the smoothing doctor 32 in this instance being a doctor roll which levels and smoothes the coating film. The doctor 32 is carried on a supporting beam 34 across the web to support structures on either side of the web. Typically for a film coater coating both sides of the web, one smoothing doctor 32 is provided to engage each side 18 of the web 20, in staggered fashion, as illustrated, so that one side 18 of the web may be smoothed first and the other side 18 is smoothed next.

Figure 2:
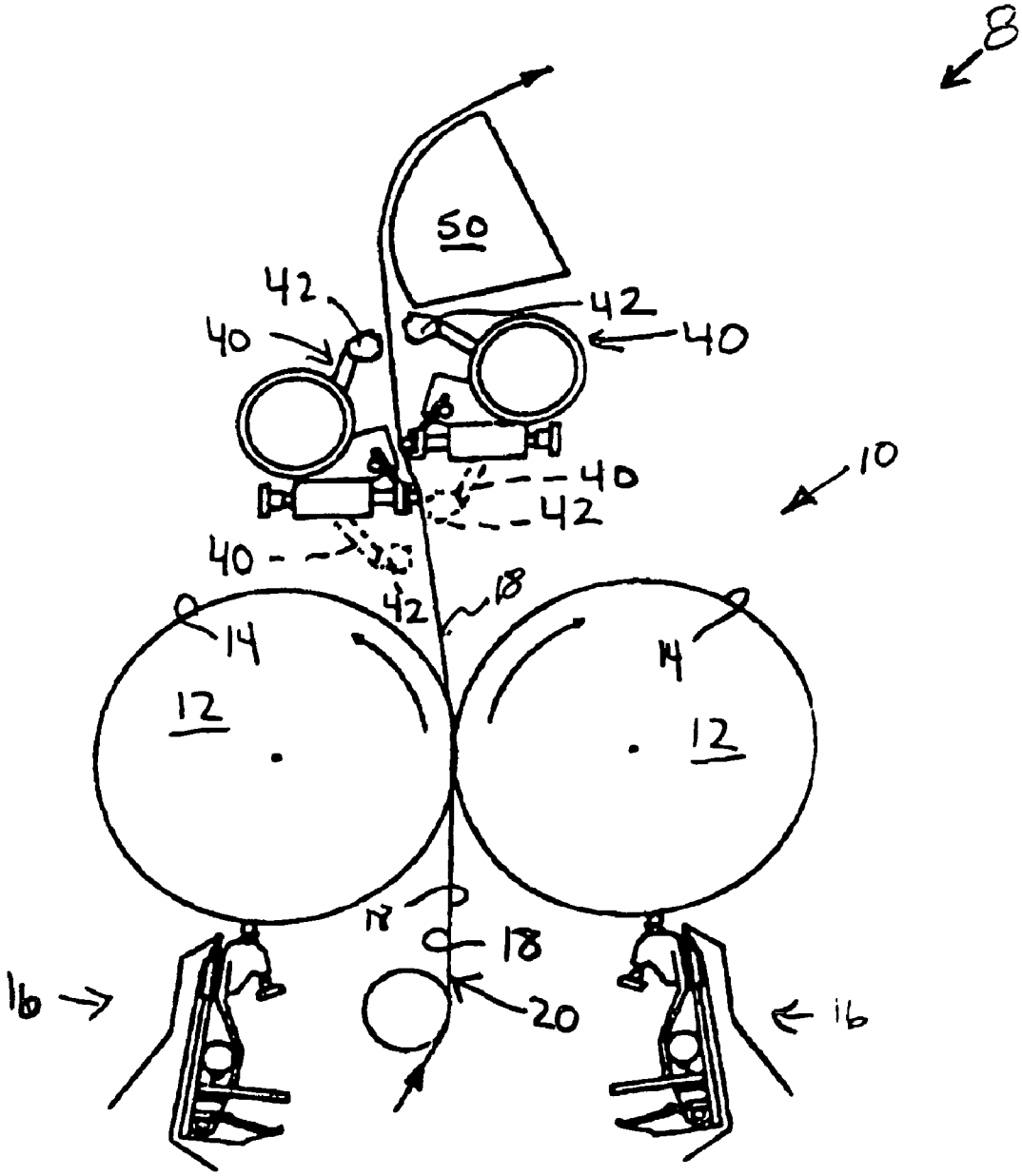
FIG. 2 is a schematic elevational view of the components and method of the present invention, illustrating a film coater with an uprunning paper web, utilizing steam and/or water mist showers above smoothing rolls to provide a smooth coated paper surface at high speeds, with another set of optional showers shown below the smoothing rolls in phantom or dashed lines.

To aid in smoothing, the apparatus 8 is proposed to include at least one shower 40 adjacent each smoothing doctor 32, mounted in a manner to be below or upstream of the smoothing doctor 32, as shown in FIG. 1, or to be above or downstream of the smoothing doctor 32, as shown in FIG. 2. In another alternative or optional embodiment, as illustrated in FIG. 2, optional showers 40 can also be incorporated to position each smoothing doctor 32 between a pair of upper and lower showers 40. The upstream shower assists smoothing as it keeps the coating levelable before doctoring. The downstream shower assists smoothing as it prolongs the flowability of the coating after doctoring. Of course, one or the other or both locations, upstream or downstream, could be used. Alternatively, coating rheology may be such that showers are not deemed necessary before or after doctoring.

The shower after the doctoring roll 32 helps minimize any "film split" effect caused by the coated sheet leaving the smoothing roll 32. Similarly, a shower before the smoothing roll helps minimize "film split" effect when the coated web leaves the film coater nip and to enhance the smoothing action of the doctors. Preferably, the smoothing rolls do not and are not intended to remove a significant, if any, amount of coating from the web, but are intended primarily to just smooth the coated web leaving the film coater. Of course, the removal of a small amount of coating is still within the teaching of the invention, and would not avoid infringement. The smoothing action would help level any fibers that were raised by the film splitting action back down to the coating surface.

The smoothing doctor or roll 32 would be of a length to extend across the web being coated, and of say ⅜ inch to 1½ or 2 inches in diameter. If a larger diameter smoothing rod or roll is used, say of ½ of an inch or more, if desired, it could be of "sweated" construction, that is, having a tubular construction and/or with a cooling passage, say for chilled water running through it. It is believed that web tension would provide sufficient force against the smoothing doctor to accomplish the desired smoothing action.

Each shower 40 includes a head 42 directed toward the side 18 of the web 20 moving therepast, with the head 42 delivering steam and/or a water mist against the web 20, to maintain smoothability of the film of coating by keeping same from drying too soon. Thus, the showers 40 are provided to maintain the film of coating moist for enhanced smoothing action.

Once leveling and smoothing is accomplished, then drying of the film of coating may be achieved through use of conventional dryers (not shown) located downstream or after, say, an air turn 50.

Moving of the web 20 upwardly through the apparatus 10, while maintaining the coating applicators 16 in the III or IV quadrant of each roll 12 will not only substantially minimize, if not altogether eliminate, "film split" and "film split" droplets or misting from adversely effecting web surface quality, but will also allow for faster processing and increased paper production speed and capacity.

For ease of threading the webbing through the coater, the steam showers could be made retractable from the web during threading. One way to accomplish this would be to mount the showers with the doctors so that when the smoothing rolls or doctors are retracted, the showers will move with them to permit easy thread of the web in the film coater.

While it is desirable to have an uprunning web, the use of the smoothing doctor and smoothing action after the web leaves the nip would be advantageous in film coater with other type web runs, be it downward, horizontal or at some angle.

The film coater and method of the present invention would work with various type applicators applying coating to the roll surface such as SDTA, jet or fountain applicator with blade or rod metering, on curtain type applicators.

While a smoothing doctor in the form of a rod say from 0.375 inches to 1.500 inches would be used, a blade would also be used, say of from 0.015-0.250 inches. The thicker blade could be hollow and chilled with cold water or held in a chiller holder. A thin blade could also be held by a chilled holder.

Referring to FIG. 2, the alternative arrangement of showers are shown. And if needed, the shower locations of either FIG. 1 or FIG. 2 could be used, or the shower locations of both FIGS. 2 and 3 could be used.

Another alternative would be to conduct the smoothing operation in a humid environment, such as a steam or water vapor filled enclosure. The humidity or steam would help keep the coating pliable for smoothing and help prevent any "build up" of coating on the smoothing apparatus itself. It should be understood that misting or steam showers could also be provided within the enclosure or the source of the humidity for the smoothing operation. Alternatively, the humidity or steam enclosure could be used without any other showers.

Figure 3:
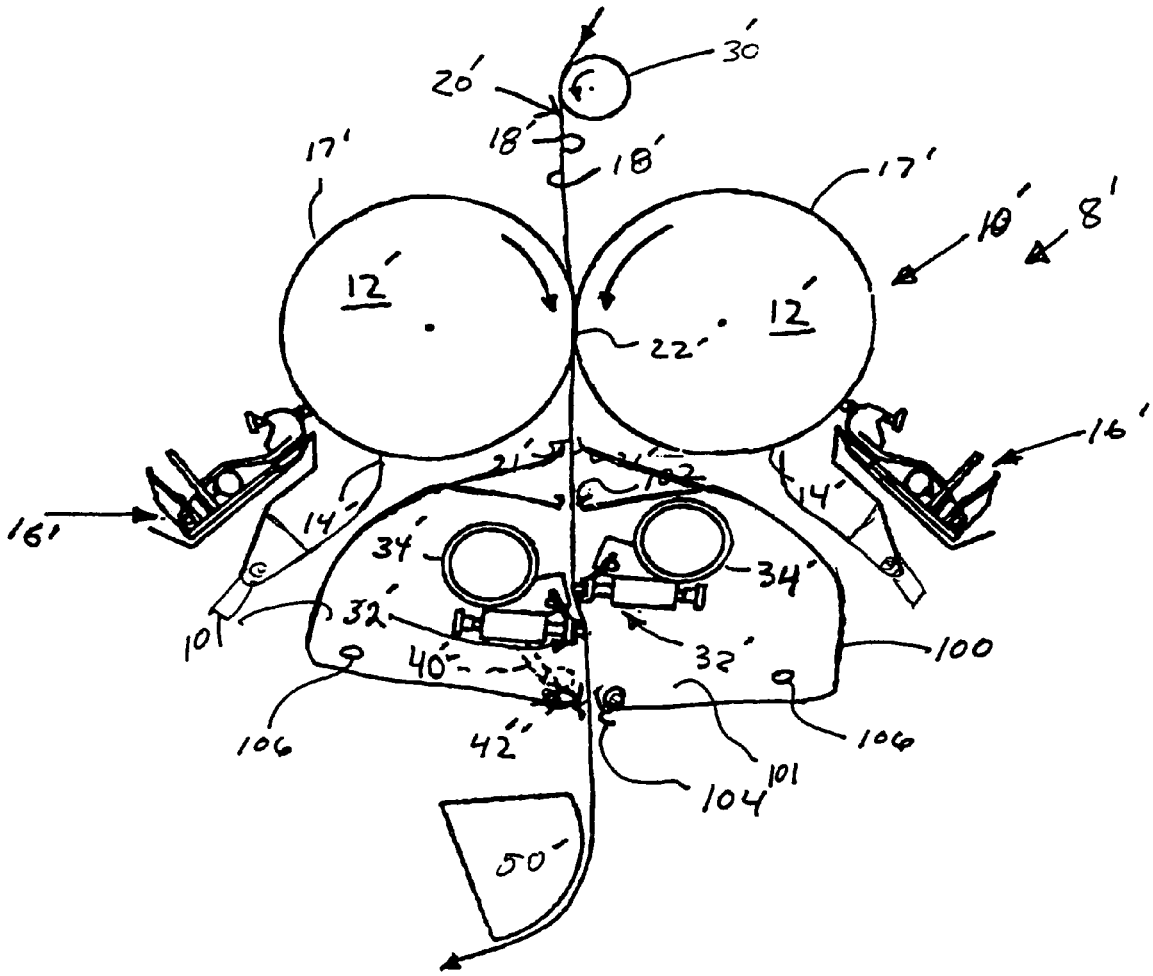
FIG. 3 is a schematic elevational view of the components of the present invention illustrating a film coater with a downrunning paper web, utilizing an alternative or optional steam or humid enclosure over the smoothing rolls.

Referring to FIG. 3, a film coater, but this time with a downrunning web is shown. For convenience, the portions of FIG. 3 similar to those shown in FIG. 1 are given the same reference numeral, except the reference numeral is primed, that is, the roll 12 of FIG. 1 would be shown as 12' in FIG. 3. The principal differs in FIG. 3 are that the web 20' run is downrunning and the smoothing doctors 32' are now located in an enclosure 100 which would contain humidity (water vapor or steam) 101. The enclosure has an entrance 102 and an exit 104 for the web 20'. If desired, showers of either type (steam or water) could be located in the enclosure to provide the humidity or the water vapor or steam could come from one or more outlets 106. The operation of the 8' apparatus of FIG. 3 is generally similar to apparatus 8 of FIG. 1, except the advantage of collecting any misting coat onto the deporting roll surfaces, instead of the web, would not be enjoyed. However, the effects of the smoothing rolls or doctors 32' and smoothing operation in providing a smoother paper, reducing fiber rise and orange peel would be present.

It will be understood by those skilled in the art, of course, that other treatments, such as subsequent coating, if desired, and ultimate winding into a roll, can be accommodated by both the apparatus 8 and method as described above.

Also, arrowheads are shown in the Figures of the drawings to indicate the general direction of web movement and roll rotation.

As used herein, the term "film coater" may also encompass "metering size press" or "film press". As used herein, the term "uprunning web" is a web that travels upward from the film coater nip at an angle of 30° either side of vertical.

As described above, the apparatus 8 or 8' and method of the present invention provide a number of advantages, some of which have been defined above and others of which are inherent in the invention. Also, modifications including equivalent structure and/or steps may be provided without departing from the teachings herein. Accordingly, the scope of the invention is only to be limited as necessitated by the accompanying claims, and that equivalent elements and steps to those recited therein would fall within the scope of those claims.

What is claimed is:

1. Apparatus for coating a paper web on both of its sides, comprising a film coater having a pair of rolls for coating the paper web, said rolls forming a nip, at least one applicator for each of said rolls, said applicators being located on its respective roll to provide coating to the nip formed by said rolls, a guide roll for said web below and upstream of said nip and below said rolls, the paper web adapted to run about said guide roll up toward said rolls and said nip and through said nip, each of said applicators apply a metered amount of coating onto the each roll surface of each of the rolls, said roll surfaces transfer the metered coating from said roll surfaces onto the sides of the paper web at said nip, two leveling and smoothing devices, one thereof located on each side of the paper web and after and above said rolls, roll surfaces and nip to level the coating on each side of the paper web and smooth the coating thereon, the paper web adapted to run upwardly from said nip through and above said leveling and smoothing devices, film split droplets or mist forming above said nip by said rolls moving apart generally fall down onto said roll surfaces and being returned to said applicators, said smoothing and leveling devices being offset from one another, including an enclosure for enclosing the smoothing devices and means for providing a humid atmosphere within said enclosure so that said paper web and the leveling and smoothing devices are in said humid atmosphere, wherein said humid atmosphere is water vapory, whereby the upwardly moving paper web can be coated and the film split droplets and mist generally fall back onto the roll surfaces.

2. Apparatus for coating a paper web on both of its sides, comprising a film coater having a pair of rolls for coating the paper web, said rolls forming a nip, at least one applicator for each of said rolls, said applicators being located on its respective roll to provide coating to the nip formed by said rolls, a guide roll for said web below and upstream of said nip and below said rolls, the paper web adapted to run about said guide roll up toward said rolls and said nip and through said nip, each of said applicators apply a metered amount of coating onto the each roll surface of each of the rolls, said roll surfaces transfer the metered coating from said roll surfaces onto the sides of the paper web at said nip, two leveling and smoothing devices, one thereof located on each side of the paper web and after and above said rolls, roll surfaces and nip to level the coating on each side of the paper web and smooth the coating thereon, the paper web adapted to run upwardly from said nip through and above said leveling and smoothing devices, film split droplets or mist forming above said nip by said rolls moving apart generally fall down onto said roll surfaces and being returned to said applicators, said smoothing and leveling devices being offset from one another, including an enclosure for enclosing the smoothing devices and means for providing a humid atmosphere within said enclosure so that said paper web and the leveling and smoothing devices are in said humid atmosphere, wherein said humid atmosphere is steam, whereby the upwardly moving paper web can be coated and the film split droplets and mist generally fall back onto the roll surfaces.

3. Apparatus for coating a paper web on both of its sides, comprising a film coater having a pair of rolls for coating the paper web, said rolls forming a nip, at least one applicator for each of said rolls, said applicators being located on its respective roll to provide coating to the nip formed by said rolls, a guide roll for said web below and upstream of said nip and below said rolls, the paper web adapted to run about said guide roll up toward said rolls and said nip and through said nip, each of said applicators apply a metered amount of coating onto the each roll surface of each of the rolls, said roll surfaces transfer the metered coating from said roll surfaces onto the sides of the paper web at said nip, two leveling and smoothing devices and one thereof located on each side of the paper web and after and above said rolls, for leveling the coating on each side of the paper web and smoothing the coating thereon, an enclosure for enclosing said smoothing leveling devices and means for providing a humid atmosphere within said enclosure so that said paper and said leveling and smoothing devices are in a humid atmosphere, the paper web adapted to run upwardly from said nip through and above said leveling and smoothing devices, film split droplets or mist forming above said nip by said rolls moving apart generally falling down onto said roll surfaces and being returned to said applicators, said smoothing and leveling devices being offset from one another, whereby the upwardly moving paper web can be coated and the film split droplets and mist generally falls back onto the roll surfaces.

4. An apparatus as in any of claims 1, 2 or 3, including showers above and after said nip for maintaining the smoothability of the coating.

5. An apparatus as in claim 4, wherein said showers are located before the leveling and smoothing devices.

6. An apparatus as in claim 4, wherein said showers are located after the leveling and smoothing devices.

7. An apparatus as in any of claims 1, 2 or 3, wherein said leveling and smoothing devices comprise doctors.

8. An apparatus as in claim 7, wherein said applicators are located in a III or IV quadrant of said two rolls and said leveling and smoothing devices are two doctors, said doctors being staggered to doctor first one side and then the other side of the paper web.

9. An apparatus as in claim 7, wherein above the nip there are only two of said leveling and smoothing devices, one only of said leveling and smoothing devices on each side of the web.

10. An apparatus as in claim 7, wherein said applicators are one of SDTA and jet applicators and said one of SDTA and jet applicators apply coating directly onto the exposed roll surface, and then the coated roll surfaces travel to the nip and transfer the coating to the respective opposite sides of the web at the nip.

11. An apparatus as in claim 3, wherein said humid atmosphere is one of water vapor and steam, said leveling and smoothing devices comprises one of a doctor roll or doctor blade, and said applicators being located in a III or IV quadrant of said two rolls.

* * * * *

UNITED STATES PATENT AND TRADEMARK OFFICE

CERTIFICATE OF CORRECTION

PATENT NO. : 7,591,898 B2
APPLICATION NO. : 11/999944
DATED : September 22, 2009
INVENTOR(S) : Wayne A. Damrau and John F. Bergin It is certified that error appears in the above-identified patent and that said Letters Patent is hereby corrected as shown below:

Column 6, line 56, "vapory" should be "vapor"

Signed and Sealed this

Fifteenth Day of December, 2009

David J. Kappos

David J. Kappos
*Director of the United States Patent and Trademark Office*